United States Patent [19]

Lehmann et al.

[11] Patent Number: 4,573,672

[45] Date of Patent: Mar. 4, 1986

[54] PAPER FOLDING MACHINE

[75] Inventors: Werner Lehmann, Gutach; Rainer Fecker, Furtwangen; Manfred Fuss, St. Georgen, all of Fed. Rep. of Germany

[73] Assignee: Mathias Bäuerle GmbH, Fed. Rep. of Germany

[21] Appl. No.: 701,182

[22] Filed: Feb. 13, 1985

[30] Foreign Application Priority Data

Feb. 17, 1984 [DE] Fed. Rep. of Germany ..... 3405763
Dec. 24, 1984 [DE] Fed. Rep. of Germany ..... 3447301

[51] Int. Cl.[4] ..... B42C 1/00
[52] U.S. Cl. ..... 270/45; 493/420
[58] Field of Search ..... 270/45–51, 270/5, 16, 17; 493/405, 409, 419–421

[56] References Cited

U.S. PATENT DOCUMENTS

| | | | |
|---|---|---|---|
| 3,255,569 | 6/1966 | Hannon et al. | 270/45 |
| 3,416,785 | 12/1968 | Sherman | 270/45 |
| 4,167,265 | 9/1979 | Whittenberger | 270/5 |
| 4,403,981 | 9/1983 | Wiithrich | 493/420 |
| 4,518,380 | 5/1985 | Shimizu et al. | 493/420 |

FOREIGN PATENT DOCUMENTS

| | | | |
|---|---|---|---|
| 1761415 | 1/1978 | Fed. Rep. of Germany | 493/420 |
| 355959 | 9/1931 | United Kingdom | 493/420 |
| 692506 | 6/1953 | United Kingdom | 270/45 |

*Primary Examiner*—E. H. Eickholt
*Attorney, Agent, or Firm*—McGlew and Tuttle

[57] ABSTRACT

A folding machine for folding sheet material comprises a housing defining a space and having an in-take opening and a discharge opening for sheet material before and after it is folded. A frame is provided in the housing and carries four rollers which are engaged with each other to form a take-in nip for receiving sheet material from the in-take opening, a first folding nip for executing a first fold on the paper and a second folding nip for executing a second fold of the paper. The rollers are engaged to each other by gears and are rotated by a single electric motor for moving the sheet material from the take-in nip to the first folding nip and from the first folding nip to the second folding nip. A pocket is formed upstream of the first folding nip in the housing for receiving the sheet of paper to stop its forward progress. The sheet of paper is continued to be fed by the take-in nip so that it folds into the first folding nip which draws the now once folded paper from the first pocket. A second pocket is provided downstream of the first folding nip to permit the second folding nip to form a second fold whereupon the folded sheet material is discharged through the discharge opening of the housing. The housing is formed in two articulated parts as is the frame so that the housing can be opened. Three of the rollers which define the take-in and second folding nips are connected to one part of the frame so that when the housing is opened these rollers are separated from the other roller. The housing and frame are designed to open on a plane which is near a tangential plane passing through the first folding nip. When the housing is opened the rollers and the pockets are exposed for removing paper that might have jammed in the folding machine.

20 Claims, 14 Drawing Figures

7
58
40
8
38
36
21/1
37
15/5
41/1
109
91
43
40/2
53
54
49
50
W3
W1
5/4
44
20'
98/1
85
84/1
10
100
88
99
89/1
24/1
W2
5/3
W4
80/1
77/1
77/2
83/1
84/2
15/4
9
40
41/1
40/1
120
125
126
40/2
S1
T1
T2
T3
127
122
121
123
124
W1

PAPER FOLDING MACHINE

FIELD AND BACKGROUND OF THE INVENTION

The present invention relates in general to a device for folding sheet material such as paper, and in particular to a new and useful upset folding machine which has four rollers running parallel to each other in a frame, the rollers being driven by a common electric motor. The rollers are in contact with each other to form a plurality of nips for taking up the sheet material and to form folding lines.

Folders of this type in the prior art have included folding pockets in the vicinity of some of the roller nips. The machine included a feed table and a delivery table.

Folders of this kind have been known for a long time (German patent No. 856,442). In a prior art machine of this construction, the folding pockets are formed by arcuate slots which are provided at uniformly spaced apart locations in sheet metal partitions between two frame walls. The drive motor is accommodated in recesses therebetween. The feed table extends above the delivery table. The frame is not enclosed at all. No housing is provided. In spite of that, undesirably accumulated paper is difficult to remove from this prior art machine. The feed and delivery tables require much space, and so does the assembled machine. In addition, it is necessary with this prior art folder to bring the paper sheets to be individually fed, in advance into an aligned position at a guide rail of the feed table, to avoid oblique folds. The feed table is therefore indispensable for correct folding. Both the bulkiness and the difficulty in remedying disturbances by paper accumulation, etc., make such a machine unsuited for a zig-zag or wrap-type folding of the sometimes sparse daily mail in an office.

SUMMARY OF THE INVENTION

The present invention is therefore directed to a machine of the above mentioned kind which can be manufactured in a simple and inexpensive way, is easy to operate, rugged in construction so that it can be set up in any office, and suited for folding individual pieces of mail, such as those of standard sizes DIN A4 or DIN A5, which may include several sheets. Also, the machine is to be as noiseless as possible and permit a simple removal, also by unskilled persons, of disturbances in operation such as caused by paper accumulation between the rolls or in the folding pockets.

Accordingly an object of the present invention is to provide an upsetting or buckling folding machine which comprises four rollers that are mounted in a frame and are driven by a common electric motor. The rollers extend parallel to each other and are in engagement with each other so that two pairs of cylindrical surfaces of the rollers are in contact to form a take-up line and two consecutive folding lines at nips between the rollers. Folding pockets are formed both ahead of and behind the first folding line and a feed table substantially aligned with the take-up line is provided. A housing encloses at least the rollers and the folding pockets and has a discharge opening. Three of the rollers which form the take-up line and the second folding line are disposed, along with the feed table and the discharge opening, at one side of a tangent plane passing through the first folding line. The last roller is disposed, along with the two folding pockets and the drive motor, at the other side of the tangent plane. The invention is particularly characterized in that the frame, and the housing which completely encloses the frame, are divided into two parts which are hinged or otherwise connected to each other and which are detachable or capable of being swung open or or being taken apart.

This design offers the advantage that the two parts of the frame and the housing can be separated from each other in the zone of the tangent plane of the first folding line, to make both the rollers and the folding pockets accessible from the outside over their entire length and the entire height of the housing. In this way paper sheets that have gone astray, which are crumpled or in any other way cause a disturbance in operation can easily be removed.

Taking apart and, particularly, reassembling the two parts of the frame and the housing is very simple and easy, due to the provided hinge and/or locking elements.

The hinge may be provided close to the bottom of the housing with the hinge pin extending parallel to that bottom or to the rollers, or the hinge pin may extend vertically at one of the side walls of the housing.

A particularly advantageous embodiment requiring little space and being easy in operation and simple in manufacture is obtained by providing that the two rollers forming together the second folding line are jointly mounted in a frame part which can be swung away from the other two rollers.

Then. for example if paper has undesirably accumulated the supporting frame can be opened very easily and all rollers become directly accessible.

If, at the same time, a separate housing part including the discharge opening is secured to the frame part which can be swung out, another advantage is obtained in that there is no need for separately opening the housing. The housing and frame are opened and closed jointly.

With the contacting rollers being operatively connected to each other in a manner known per se, through meshing gears, the rollers mounted in that part of the housing in which also the electric motor is mounted may be permanently operatively connected with the motor, for example, by a drive belt. While taking or swinging the two frame and housing parts away from each other and bringing them together again, the gears of the two rollers forming the first folding line can be mutually disengaged and re-engaged without any difficulties.

If only two paper sizes, e.g. DIN A4 and DIN A5, are to be folded always in the same folding mode with this machine, the folding pockets may be provided with fixed stops set to a folding length of ⅓rd of the A4 size. It is further possible to provide folding pockets extending arcuately instead in a straight line, to flatten the structure. To be able to fold the A5 size (which is the next smaller one from A4), to the same extent in the folded state, i.e. to ½, one of the two folding pockets must be closed. This may be done, in a manner known per se, by providing at the entrance of the second folding pocket, i.e. the pocket behind the first folding line, a flap which is adjustable from the outside and serves at the same time as a guide plate to the second folding line.

To make the operation of the folding machine simple, means are also provided to bring the manually insetted paper sheets mechanically in alignment before they are pulled between the rollers to avoid oblique folding.

To this end, a further development of the invention provides that the feed table, or at least the end portion thereof close to the take-in line, points against the cylindrical surface of one of the rollers forming the takein line.

If a feed table is provided for this purpose which leads into the housing obliquely from top to bottom, the alignment of the paper sheet respectively put in (this also holds for double or triple sheet thicknesses) can be automatic or take place with manual help before the rollers are started. The rollers could be started, in the simplest way, by means of a manually operable switch, with which the electric motor can be turned on and off manually. For safety reasons and in order to prevent the machine from remaining turned on longer than absolutely necessary, it is provided in a further development of the invention that a sensing switch, such as in the form of a light barrier or the like, is disposed in a feed path or track determined by the table, which sensing switch, interacting with an electric timing element, turns on the electric motor with delay when putting in material to be folded, turning it off again at the earliest after one work cycle.

For delayed stopping of the electric motor after the work cycle is concluded there would also be the possibility to provide, in the area of the discharge track leading to the discharge opening, a second sensing switch which takes care of shutting off the electric motor when the folded material protrudes from the discharge opening.

While is is necessary, or at least advantageous, for this kind of alinging where the material to be folded is aligned with the outside diameter of one of the two rollers forming the take-in line, to make the feeding table so long in the feeding direction that at least almcst the entire surface of the paper sheets to be folded can lie on it, the provision of a motordriven aligning device provides the possibility of making the feed table very short in the takein direction. But this requires that the motordriven aligning device causes the leading transverse edge of the material to be folded to make contact with one of the two rollers forming the take-in line before these rollers are caused to rotate.

To make this possible, the invention provides, in a further development, that the motor shaft of the electric motor which can be turned on without delay by a sensing switch disposed in the feed track determined by the feed table and turned off again by a timing element or by a second sensing switch disposed in the discharge track, can be brought into driving connection with the rollers through a clutch responding with time delay, e.g. a centrifugal clutch.

This embodiment offers the advantage that the electric motor driving the rollers can also be utilized to drive the aligning device.

In a further embodiment of the invention it is provided that the feed table is equipped with a transport roller, a part of its outside diameter projecting into the input path or track and at least two mutally spaced, stationarily disposed balls of the pressure rollers resting against it loosely or elastically and rotatably as pressure means, and that this transport roller is in direct driving connection with the motor shaft of the electric motor which can be switched on without delay by the sensing switch, whereas the other rollers are started later by the electric motor via the clutch responding with time delay.

It can be assured in this manner that, before the rollers effecting the take-in and folding of the material to be folded start turning, the material to be folded is safely and correctly aligned with the still stopped outside diameter of one of the two rollers forming the take-in line, despite the fact that these rollers and the transport rollers are driven jointly.

While it is possible to use for the time-delayed starting of the electric motor at the beginning of the folding process and for its time-delayed shutoff at the end of each folding process electronic time switches which, however, make for an expensive circuit, a considerably simpler and cheaper embodiment of the invention provides:

that, to turn the electric motor on and off, there is disposed in an input path or track determined by the feed table, or in its vicinity, at least one mechanical sensing switch operable by the material to be folded or operable manually;

that there is connected in parallel to this sensing switch a closing switch which is actuated by the magnetic leakage field of the electric motor and kept closed during the duty cycle of the electric motor; and that there is connected in series to the sensing switch and the closing switch jointly a disconnecting switch which is opened briefly at the end of each folding process by a cam plate revolving once during one folding process to turn off the electric motor.

To obtain here as high a safety factor as possible, it is provided in a further embodiment of the invention that the transport distance between the transport roller, turning in synchrony with the motor shaft, and the take-in line, equals at the most the circumferential length of the transport roller so that, after one revolution of the transport roller already, the leading transverse edge of the material to be folded contacts the aligning outside diameter of the roller, whereas the clutch engages, at the earliest, after about three full revolutions of the motor shaft.

Another embodiment of the invention which facilitates handling, provides that the housing part equipped with the feed table is provided with an underframe disposed under the housing bottom and forming an inclined plane rising from the front to the vicinity of the separating line of the housing and dropping behind it.

Such an underframe offers the advantage that the two housing parts, interconnected by a flip-up joint disposed near the bottom and having a horizontal joint axis, can be flipped up more easily than would be possible if the continuously flat bottom of both housing parts were standing on a table top. Otherwise it would be necessary to lift the entire apparatus off the table to open the housing.

To achieve more space savings it is provided that the feed table has two plate sections hinged to each other, both being capable of being pivoted relative to the housing so that both plate sections can each be placed against the outside of a housing wall.

This makes it possible to reduce the space requirements for the housing length when the machine is not in use, even if a long feed table is involved.

One embodiment of the invention of particularly beneficial influence on the handling of the upset folding machine consists in that the discharge opening is disposed above the feed table at a distance from the second folding line roughly corresponding to half the final size of the material being folded and bridged completely, at least approximately, by a bearing surface.

This makes it possible to set the machine up so that the finish-folded material appears in the discharge opening with half of it projecting out of the housing, and remaining there so that it can be removed readily. The material does not fall down and requires no other bearing surface protruding beyond the housing contour either.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The invention is explained in the following with reference to the drawings in which.

DESCRIPTION OF THE PREFERRED EMBODIMENTS

Figures 1, 2:
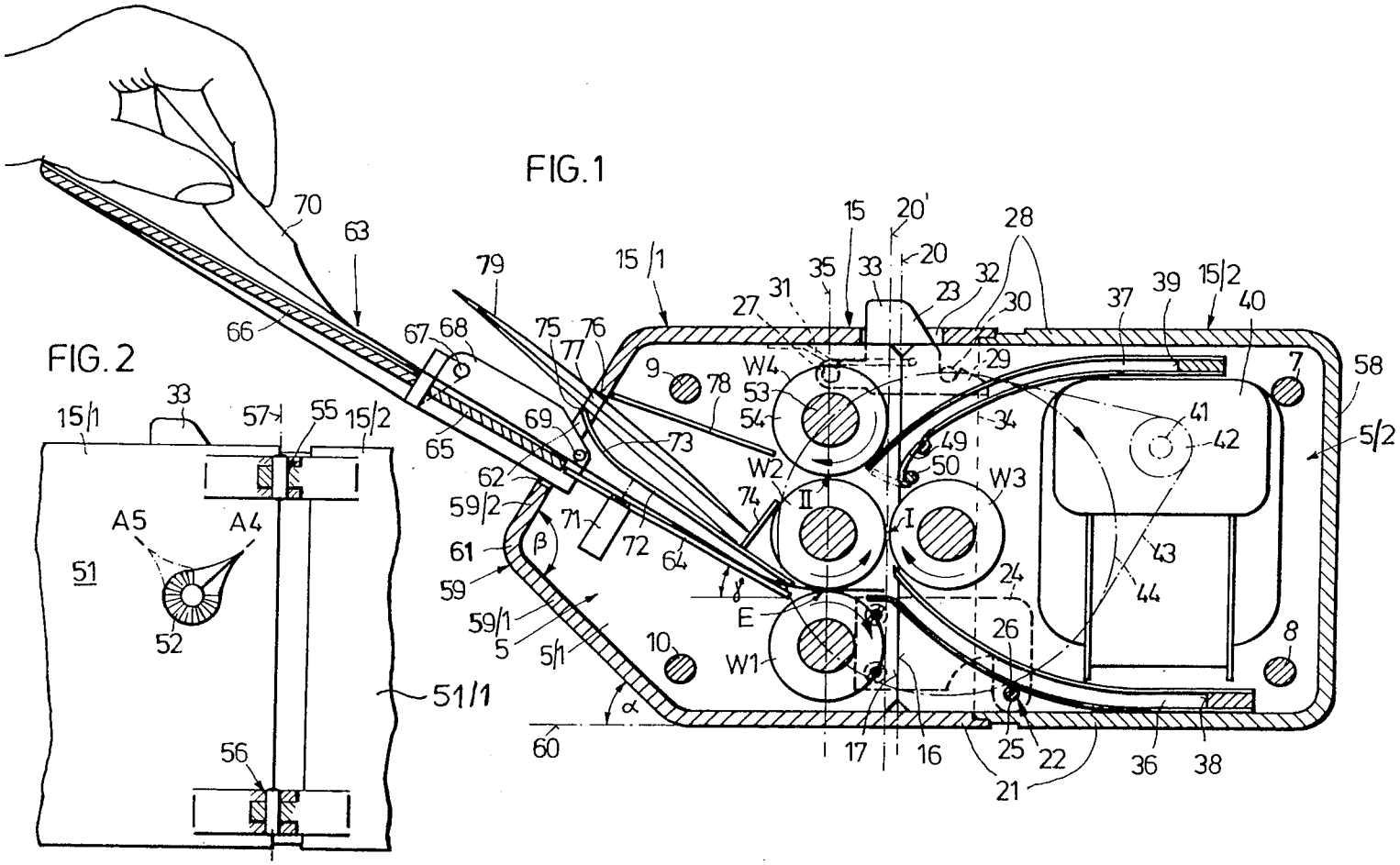
FIG. 1 shows an upset or buckling folding machine in sectioned side view.
FIG. 2 shows part of the housing of another folding machine in side elevational view.

In the following, which describes several different embodiments of the inventive folding machine, the parts which are common to all embodiments have the same reference symbols.

The upset folding machine shown in FIGS. 1 through 5 is equipped with a total of four rollers W1, W2, W3 and W4, which, running parallel to each other, are so disposed in a frame 5 that their outside diameters touch each other in pairs each, forming a take-in nip or line E as well as a first and a second folding nip or line I and II. The frame 5 consists of two parts 5/1 and 5/2, each having mutually parallcl, vertical, paired chassis 11, 12 and 13, 14 which are mutually spaced and interconnected by horizontal posts 7, 8 and 9, 10, respectively, the chassis contours being adapted without play, at least approximately, to the inside shape of a housing 15 completely enclosing the frame 5. The vertical edges 16, 17 and 18, 19 of the chassis 11, 13 and 12, 14, respectively, each disposed in the same vertical plane in mutual alignment, are in mutual contact in a vertical plane 20 and are pivotably interconnected, in the embodiment of FIG. 1, in the vicinity of the housing bottom 21 by two joints 22 and two locks 23. The joints 22 consist of a plate 24 each, fastened to the chassis 13, 14, respectively and extending by a certain amount into the area of the chassis 11, 12, respectively, where it has a horizontal hole 25 into which a pivot pin 26 fastened to the chassis 11, 12, respectfully, projects.

Locks 23 are pivotably mounted to horizontal pins 27 of the chassis 13, 14, respectively, near the top or cover wall 28 of the housing 15 and are each equipped with a detent latch 29 which is respectively engaged by a detent pin 30 of the chassis 11 or 12 for locking the housing in its closed position. The detent latch 29 is kept in engagement with the detent pin 30 by a torsion spring 31. By means of a cam 33 protruding upwardly through a slot 32 in the cover wall 28 the lock 23 can be pivoted downwardly, thereby disconnecting the detent connection between the detent latch 29 and the detent pin 30. In place of the joints 22, detent devices or locks could also be provided which make it possible to take the two frame parts apart altogether.

Figure 4:
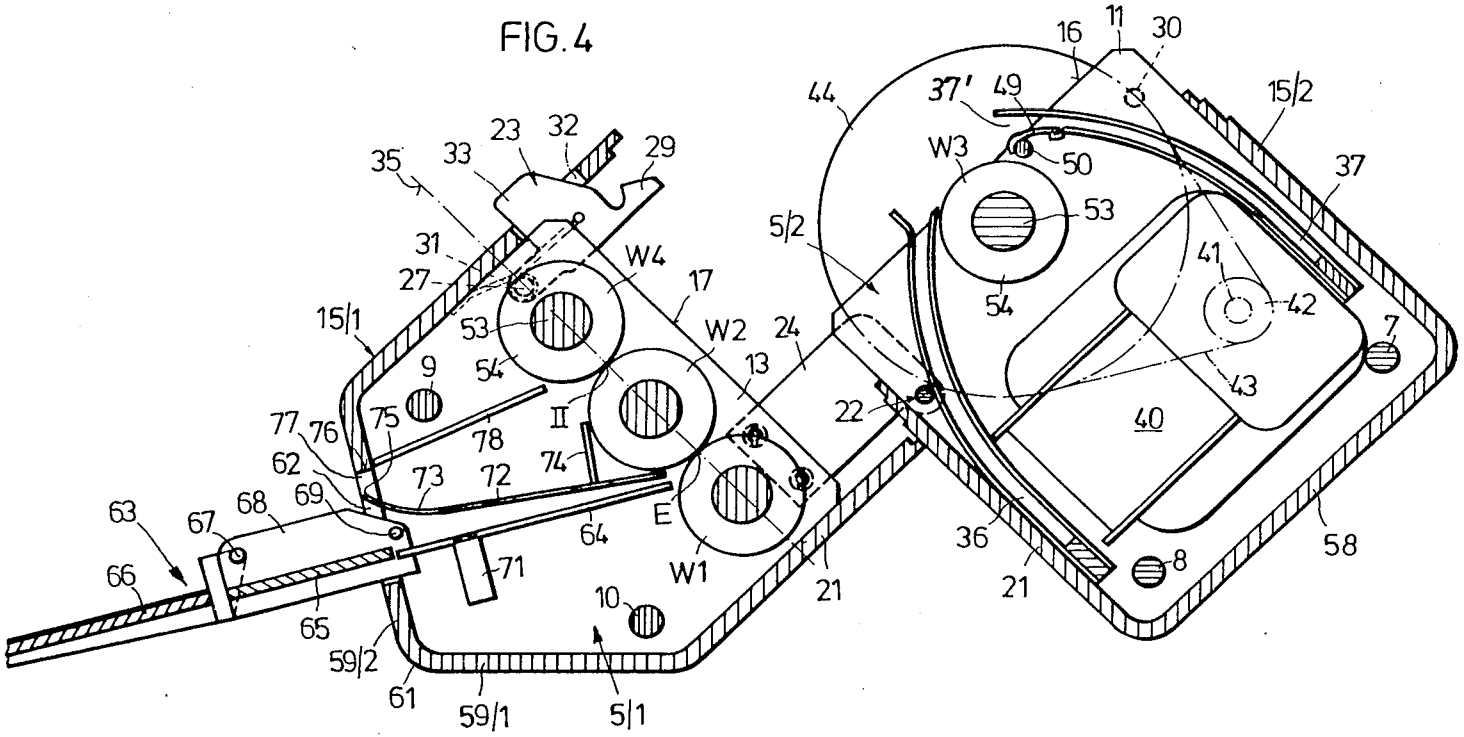
FIG. 4 is a side sectional view of the folding machine of FIG. 1, shown in an open position.
Figure 5:
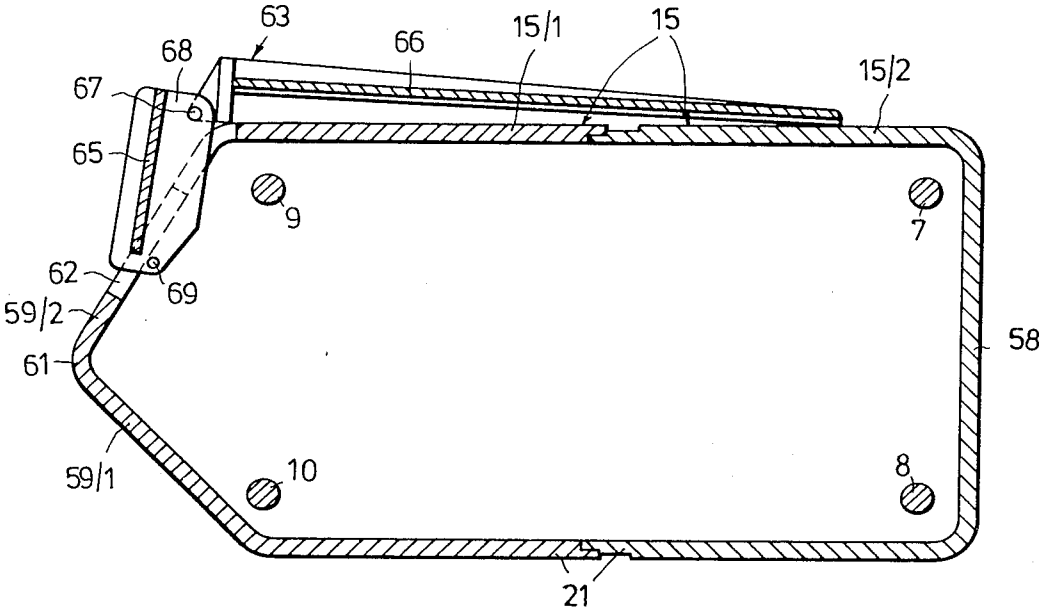
FIG. 5 is a side sectional view of the housing of the folding machine of FIG. 1 with folded feed table.

The housing 15 also consists of two parts 15/1 and 15/2, joined together along a separating line 34 so as to be form-closing, but detachable in such a manner that they can be swung open about the common axis of the two joints 22 together with the frame parts 5/1 and 5/2 housed in them, as shown in FIG. 4.

The three rollers W1, W2 and W4, forming the take-in point E and the second folding line II in pairs, are each mounted in the frame part 5/1 in a vertical plane 35 (running parallel to the separating plane 20) and disposed one above the other, i.e. between the chassis 13 and 14 on the one side of the likewise vertical tangential plane 20' of the folding line I. The fourth roller W3 is mounted on the other side of the tangential plane 20' at the level of the roller W2 in the chassis 11 and 12 which form the other frame part 5/2 so that the two rollers W2 and W3 form the folding line I when the two frame parts 5/1 and 5/2 are joined and locked together as shown in FIG. 1.

Figure 3:
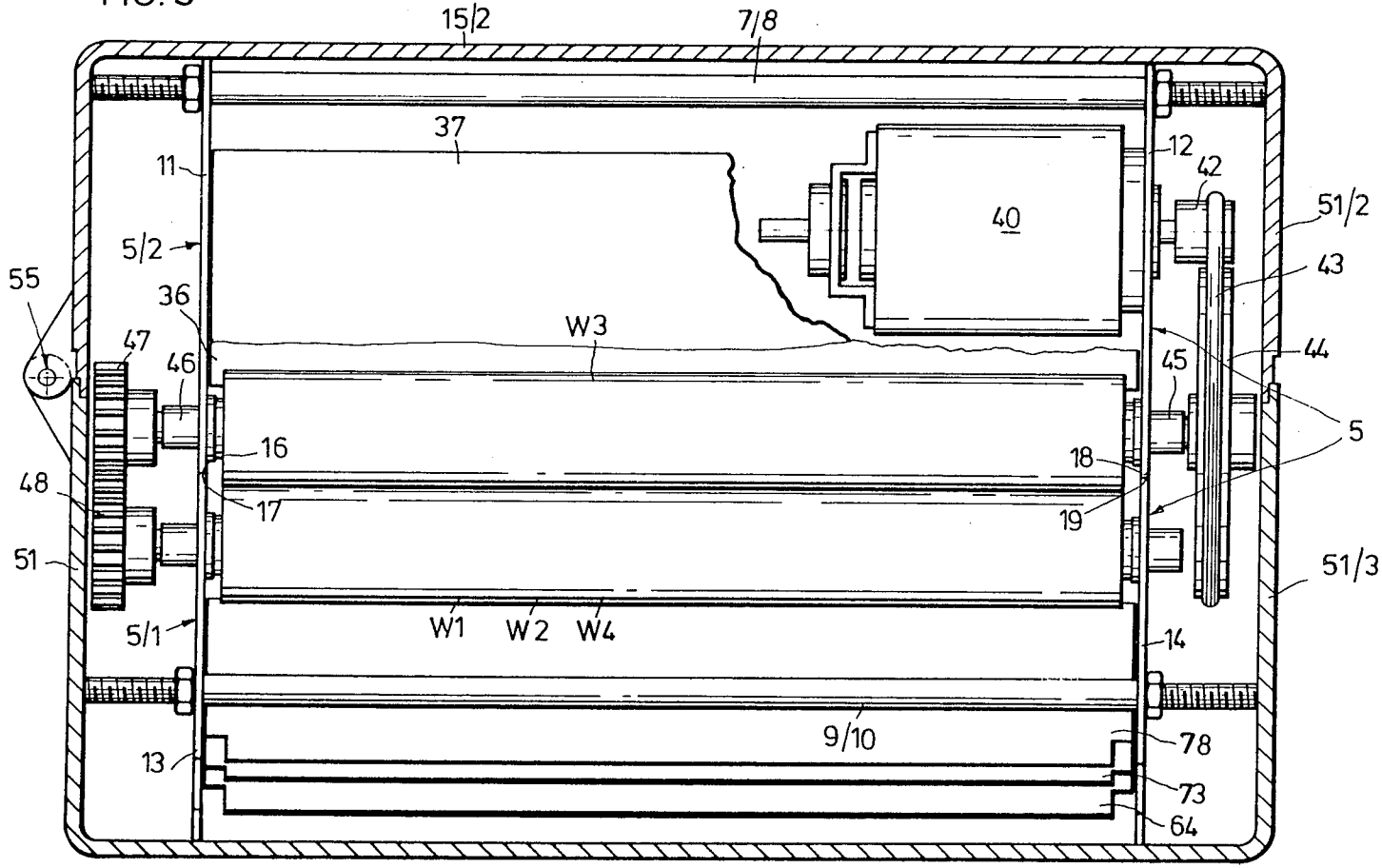
FIG. 3 is a top sectional view of the folding machine with the housing of FIG. 2.

Disposed upstream of and downstream of the folding line I in the direction of paper feed and in the frame part 5/2, are folding pockets 36 and 37, respectively. Each pocket has a fixed end stop 38 and 39, and both are of curved design in order to use as little space as possible in the vertical direction. Mounted between their end sections is an electric motor 40 whose motor shaft 41 is equipped with a belt drive 42 which, by way of a belt 43, is in driving connection with a pulley 44 fastened to a shaft end 45 of the roller W3 (FIG. 3). As may be seen in FIG. 3, the opposite shaft end 46 of the roller W3 has a gear 47 which meshes with a gear 48 of the roller W2. The rollers W1 and W4 are also equipped with gears 48, and by means of these gears they are in formclosing, rotary connection with the roller W2 so that all rollers W1 through W4 turn synchronously in the direction of the arrows shown in FIG. 1. When swinging open the housing 15 in the manner shown in FIG. 4, the gears 47 of roller W3 and 48 of roller W3 disengage. They reengage again when the housing is closed.

As this folding machine is intended essentially to fold the daily mail, i.e. paper sheets of the size DIN A4 in the manner of the socalled spiral fold, the two stops 38 and 39 of the two folding pockets 36 and 37 are arranged so that both folding pockets 36 and 37 have at least approximately the same entry depth for the material to be folded, corresponding to about one third of the length of a DIN A4 sheet.

*But in order to also have the possibility of folding* paper sheets of the DIN A5 size to the same folded size, the folding pocket 37 located downstream of the folding line I is provided at its input opening 37' (FIG. 4) with a flap 49 fastened to a shaft 50 running parallel to the roller W3. By means of this shaft 50 the flap 49 can be swung from its position shown in unbroken lines in FIG. 1, in which position it forms a part of the open input opening 37', into the position shown in dash-dotted lines, in which it closes the folding pocket 37, serving at the same time as guide plate to the second folding line II for the material to be folded. The shaft 50 is rotatably mounted for this purpose in the two chassis 11 and 12 of the frame part 5/2 and extended to the outside through the sidewall 51 shown in side view in FIG. 2 where it is provided with a setting knob 52. By means of the setting knob 52 the shaft 50 can be shifted between the two markings A4 and A5 in the manner described above.

In FIG. 3, in which the second folding pocket 37 is shown only in part for clarity, the shaft 50 with the flap 49 and the setting knob 52 is not visible either.

Yet to be mentioned is that the rollers W1, W2, W3 and W4 are of identical design and consist of a metal core 53 and a rubberlike, elastic jacket 54.

As may be seen from FIGS. 2 and 3, the two housing parts 15/1 and 15/2 can be jointed together by hinges 55 and 56 which have one commcn, vertical swivel axis 57 hinging the two sidewalls 51 and 51/1 together, instead of the joints 22 which have a common, horizontal swivel axis. In that case, a single lock 23 on the opposite side but still at the top, is sufficient to interlock the two chassis 12 and 14 or else the two lateral housing walls 51/2 and 51/3.

On the other hand, however, it is necessary for the two frame parts 5/1 and 5/2 to be firmly anchored in the housing parts 51/1 and 15/2, respectively. The advantage of these hinges 55 and 56 with the vertical swivel axis 57 over the joints 22 with the horizontal swivel axis is that the housing 15 need not be lifted off the surface on which is stands to be opened up, as is required for the opening operation according to FIG. 4.

While a rear face wall 58 of the housing part 15/2 is planar and perpendicular to the bottom 21 of the complete housing 15, the front face wall 59 of the housing part 15/1 is designed to have a triangular, salient section 59/1, rising at an angle $\alpha$ of about 45° from the bottom plane 60 and going over into an upper wall section 59/2 via an arc 61 traversing an angle $\beta$ of about 120°. This upper wall section 59/2 has a windowlike opening 62, through which a feed table 63 leads to the housing interior to the take-in line E. The complete feed table 63 consists of three parts, namely a stationary plate 64 disposed inside the housing, adjacent thereto towards the outside a shorter plate section 65, and a longer plate section 66 adjacent the plate section 65. Plate section 65 has lateral walls 68. The two plate sections 65 and 66 are interconnected by joints 67 of lateral wall elements so that the plate section 66 can be folded over upwardly from its working position shown in FIG. 1. In addition, the smaller plate section 65 is connected to the housing part 15/1 by joints 69 so that both plate sections 65 and 66 can be folded upwardly in the manner shown in FIG. 5 so that the plate section 65 assumes an approximately vertical position and the plate section 66 rests in almost horizontal position on the cover wall 28 of the complete housing 15 when the folding machine is not in use. In the operating position of the feed table 63 the two plate *sections* 65 *and* 66, *together with the plate* 64, *form an* inclined plane directed not directly against the take-in line E, but against the outside diameter of the lower roller W1 at an 20 angle of inclination $\gamma$ of about 30°. This makes it possible for the leading transverse edge of paper sheets 70 manually placed on the feed table 63, to align themselves with the outside diameter of the roller W1 as long as the latter is still standing still. It is immaterial whether the paper sheet 70 slides down against the roller W3 across the inclined feed table 63 by its own weight, or whether it is pushed down for it to align itself. This is left to the discretion of the operator. For the electric motor 40 to be switched on automatically by placing a paper sheet 70 on the feed table 63 on the one hand, there is provided in the plate 64 a sensing switch 71 in the form of a reflection light barrier. On the other hand, so that there is enough time available for the paper sheet 70 to align itself with the still stopped roller W1, the sensing switch 71 is provided with an electronic timing element which sees to it that the electric motor 40 is turned on with a time delay of a few seconds relative to the instant at which the sensing switch 71 reacts to the inserted paper sheet. Controlled by another timing element or by a second sensing switch disposed behind the folding line II, the electric motor remains turned on for one working cycle.

The light beam emitted by the sensing switch 71 is reflected by a guide plate 72 disposed a short distance above the plate 64 as long as no paper sheet 70 is put in place. This guide plate 72 has an upper section 73 which is bent up slightly and projects into the opening 62, and near the roller W2 it is provided with a piece of supporting sheet metal 74 extending approximately tangential to the outside diameter of the roller W2. Between the terminal edge 75 of the guide plate 72 and the upper terminal edge 76 of the opening 62 there is a slotshaped discharge opening 77, above which another guide plate 78 is disposed to guide the folded material 79 arriving in the discharge direction from the folding line or point II to the discharge opening 77. The spacing of the discharge opening 77 from the second folding line II is about half the length of the folded material 79. The folded material remains lying on the terminal edge 75 of plate 72 in the position shown in FIG. 1, in which it supports itself against the piece of supporting sheet metal 74, about half of it projecting out of the wall section 59/2, in such a way that it stays there and can readily be removed.

Figure 7:
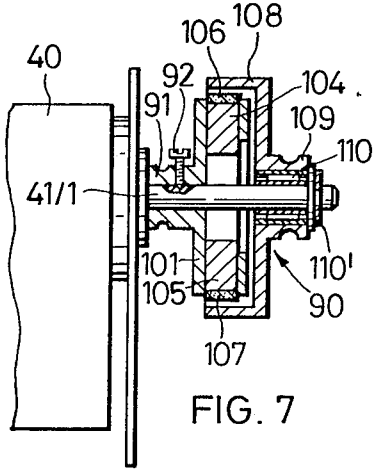
FIG. 7 is a radial sectional view of a centrifugal clutch of the machine of FIG. 6.
Figure 6:
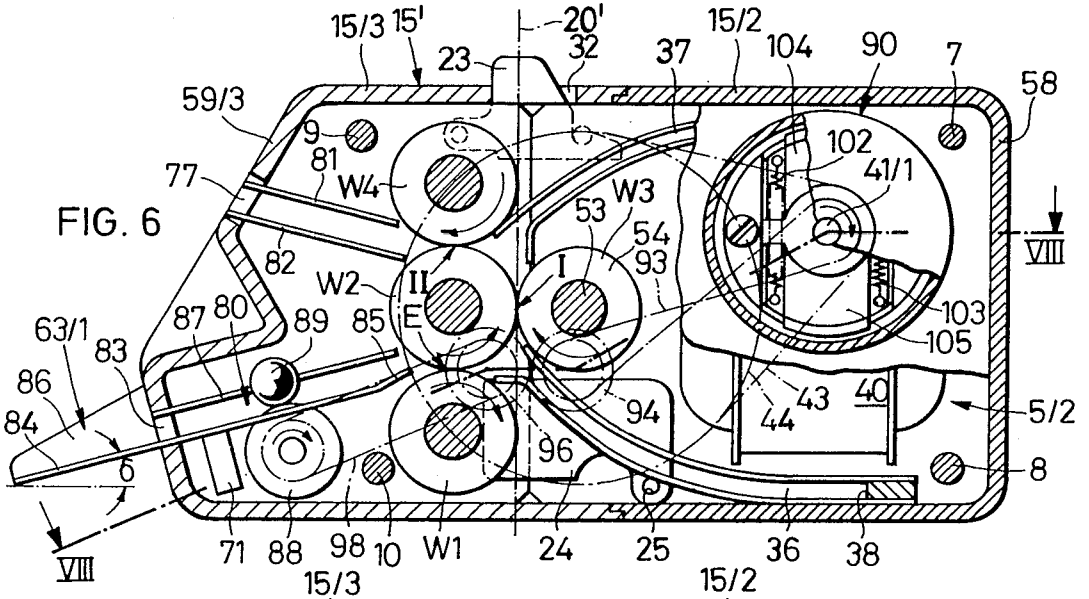
FIG. 6 is a sectional view of a folding machine equipped with an aligning device for the material to be folded.
Figure 8:
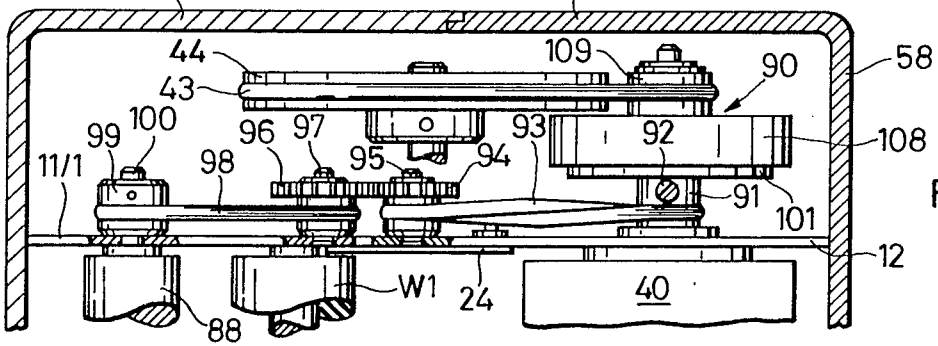
FIG. 8 is a partial sectional view taken on line VIII—VIII of FIG. 6.

The folding machine illustrated in FIGS. 6, 7 and 8 differs from the embodiment of FIG. 1 in that a shorter feed table 63/1 with a motor-driven aligning device 80 in a different configuration and another face wall 59/3 of a shorter housing part 15/3 are provided, to whose inside shane the chassis are adapted in which the rollers W1, W2, and W4 are mounted. Moreover, two parallel guide plates 81 and 82 are provided between the second folding line II and the discharge opening 77 disposed in the face wall 59/3 above the feed table 63/1. The provision of the motordriven aligning device 80 offers the possibility to keep the feed table 63/1 very short and to arrange it so as to lead into the housing to the take-in line or point E not inclined downwardly, but upwardly. It is also possible to design the feed table 63/1, like the feed table 63/2 of FIG. 9, so that its terminal front edge ends in the plane of a bearing surface, thereby making it possible to push the paper to be processed from this bearing surface onto the feed table to the aligning device 80. The feed table 63/1 consists of a guide plate 84 which goes through a slot 83 disposed in the lower area of the front face wall 59/3 into the housing interior, rising at an angle of inclination δ of about 15°, the slightly bent-up end section 85 of said guide plate 84 being directed above the take-in line or point E against the outside diameter of the roller W2. Outside the housing front wall 51/3 the guide plate 84 has two lateral wall elements 86. A second guide plate 87 is diposed above and parallel to the guide plate 84 and a short distance inside the housing. Mounted in pull-in direction immediately behind the sensing switch 71 provided here also is a transport roller 88, a part of which projects from below through the guide plate 84 into the input track, and on which rest loosely through their own weight two balls 89, retained stationarily but with vertical play and rotatably in the guide plate 87 and mutually spaced in the axial direction of the transport roller 88 by at least half the length of the transport roller 88. The transport roller 88 and the balls 89 represent the aligning device 80 inasmuch as they guide manually inserted paper sheets instantly to the outside diameter of the roller W2 in such a manner that the leading transverse edge of the respective sheet of paper is aligned with this outside diameter.

This requires that the roller W2, respectively all other rollers also, are still standing still, whereas the transport roller 88 is already turning.

To be able to drive both the rollers W1 through W4 and the transport roller 88 with the electric motor 40 jointly, but make them turn staggered timewise, there is mounted on the motor shaft 41/1 of the electric motor 40 a clutch 90, responding with time delay, in the form of a centrifugal clutch, and also a belt drive 91 fixed to the motor shaft 41/1 by means of a screw 92. Via a crossed belt 93 the belt drive 91 is in driving connection with a gear 94 rotatably mounted on a bearing pin 95 near the separating plane 20 below the roller W3 on the outside of the chassis 12. This gear 94 meshes with another gear 96 diposed exactly opposite on a bearing pin 97 of the chassis 11/1 and being in driving connection via a belt 98 with a belt drive 99 fastened to a stub shaft 100 of the transport roller 88. Due to the provision of the two gears 94 and 96, which represent a disengageable drive clutch, a direct driving connection between the motor shaft 41/1 and the transport roller 88 is established which, however, is separable without problem when opening up the two housing parts 15/2 and 15/3 in the manner shown in FIGS. 4 or 9, and reengageable again without problem when closing the two housing parts 15/3 and 15/2.

The clutch 90 consists of a disc 101 forming an integral part of the belt drive 91, in which disc are mounted two diametrically opposed and radially movable centrifugal weights 104 and 105 pulled radially inward by torsion springs 102 and 103. These centrifugal weights 104 and 105 have on their outsides friction coatings 106 and 107 which, after a certain rotary speed is reached and the radially inwardly directed pulling forces 102 and 103 are overcome, contact the inside of a potlike, annular part 108. The annular part 108 has a hub 109 which is designed as belt drive and mounted by means of an antifriction bearing 110 on the motor shaft 41/1 so as to rotate freely and secured in axial direction by means of a thrust washer 110'. This clutch 90 is adjusted so that, after the motor is turned on, the annular part 108 is taken along by the contacting friction coatings 106 and 107 of the two centrifugal weights 104 and 105 after about three revolutions of the motor shaft 41/1 which is in the process of starting. Through the belt 43 the hub 109 is in direct driving connection with the pulley 44 of the roller W3. Consequently, the rollers W1, W2, W3 and W4 start turning only upon the insertion of a sheet of paper into the slot 83 and after the transport roller 88 has performed about three revolutions. Since the transport distance which the inserted sheet of paper must travel between the transport roller 88 and the outside diameter of the roller W2 is concluded no later than after one revolution of the transport roller 88, before the roller W2 together with the other rollers W1, W3 and W4 start turning.

The folding process is the same in all embodiments. The aligned material to be folded is first guided into the folding pocket 36 after the rollers W1, W2, W3 and W4 start turning, until it comes to a standstill at the stop 38. Then it passes through the first folding point or line I, forming the first fold, runs into the folding pocket 37 up to its stop 39 and is then guided, forming the second fold at the second folding point or line II, to the discharge opening 77, from which it can then be removed manually. This sequence takes place when folding th epaper size DIN A4 in the manner of the spiral fold.

If a sheet of paper of the size DIN A5 is to be folded instead, the setting knob 52 is first switched from its position A4 into its position A5 so that the flap 49 assumes the position shown dash-dotted in FIG. 1, closing the second folding pocket 37. The material to be folded, arriving from the folding pocket 36 through the first folding point or line I is then diverted directly to the second folding point or line II, whence it again reaches the discharge opening 77.

It is clear that these folding processes can take place only in the closed condition of the housing 15 and 15', respectively.

If a paper jam occurs inside the housing, i.e. in a folding pocket or between two rolls, for instance, it can be eliminated easily by opening the housing in one of the ways described above after appropriately actuating the locks 23, thereby laying open both the folding pockets and the rolls. After the elimination of the cause of the jam in this simple manner and the housing 15' is closed and locked again, the upset folding machine is functional again.

Figure 9:
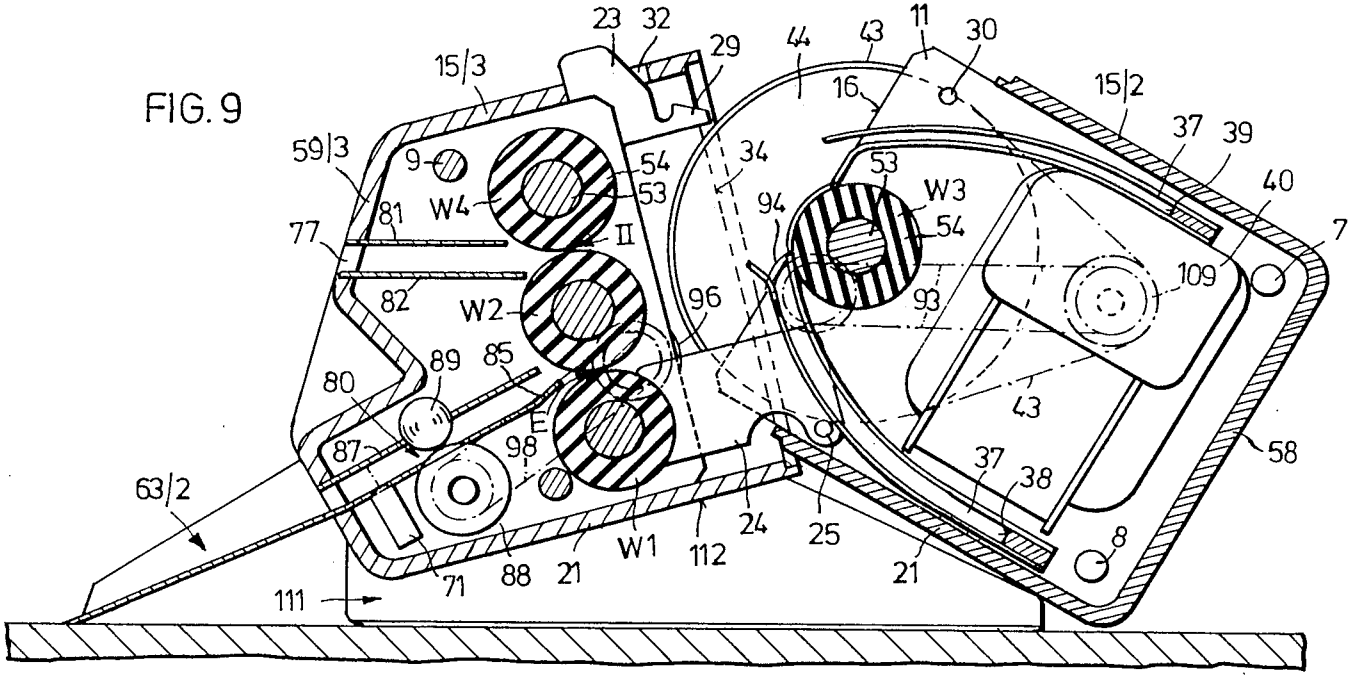
FIG. 9 shows the folding machine of FIG. 6 with a different housing a feed table and in an unfolded state, in sectional side view.
Figure 10:
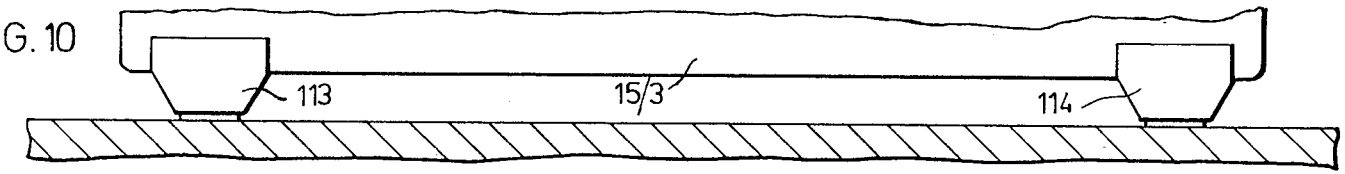
FIG. 10 is a partial front view taken from FIG. 9.

So that, also in their embodiments according to FIGS. 1, 4 and 6 where the joints 25 with their horizontal swivel axes are disposed near the housing bottom 21, the machines need not be lifted off the surface on which they stand, e.g. a desk, when opening them in the manner shown in FIGS. 4 and 9, it is advantageous to provide the housing part 15/1 or 15/3 in which the feed table 63 or 62/1 or 62/3 as well as the rollers W1, W2, W3 and W4 are disposed with an underframe 111 which forms an inclined plane rising from the front side to the vicinity of the housing separating line 34 and dropping thereafter, as shown in FIG. 9. This underframe 111 may consist of two mutually spaced base strips 113 and 114 disposed under the housing bottom 21. While this inclined plane 112 gives the entire upset folding machine in its closed state an oblique position rising from the front towards the back, this has no adverse effect on its handling and operation, but rather the advantage that the rear housing part 15/1 is easier to open, as evident from FIG. 9.

Common to all embodiments of the folding machine described is the advantage of its compactness, meaning its space-saving design, and also the ease with which is can be operated and handled. The housing 15 or 15', enclosing both the rollers W1 through W4 and the folding pockets 36 and 37 on all sides not only offers protection from contact for accident prevention, but at the same time represents an effective noise suppressant, there also being the possibility to improve the noise suppression further by producing the housing 15 or 15' of a sound absorbing material or lining the housing insides with a sound absorbing material.

Figure 11:
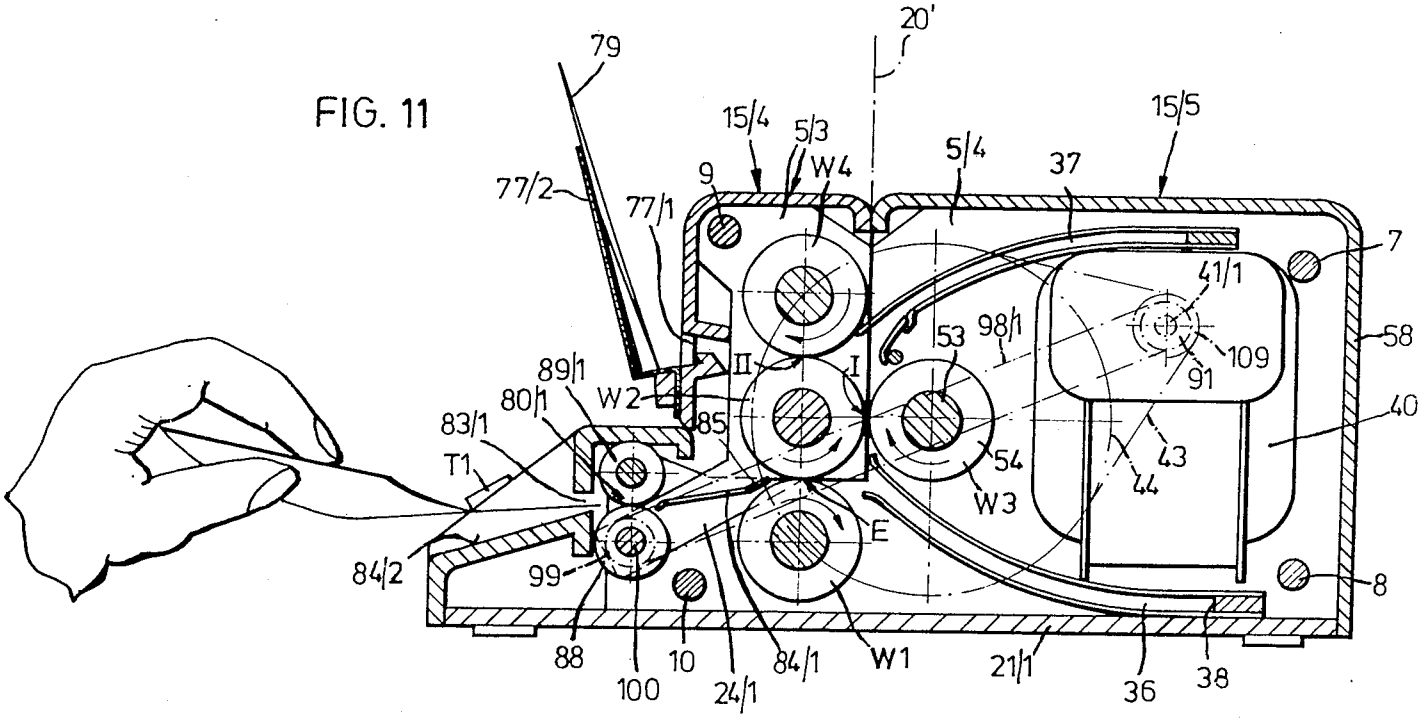
FIG. 11 is a longitudinal sectional view of another embodiment of the folding machine in closed position.
Figures 12, 14:
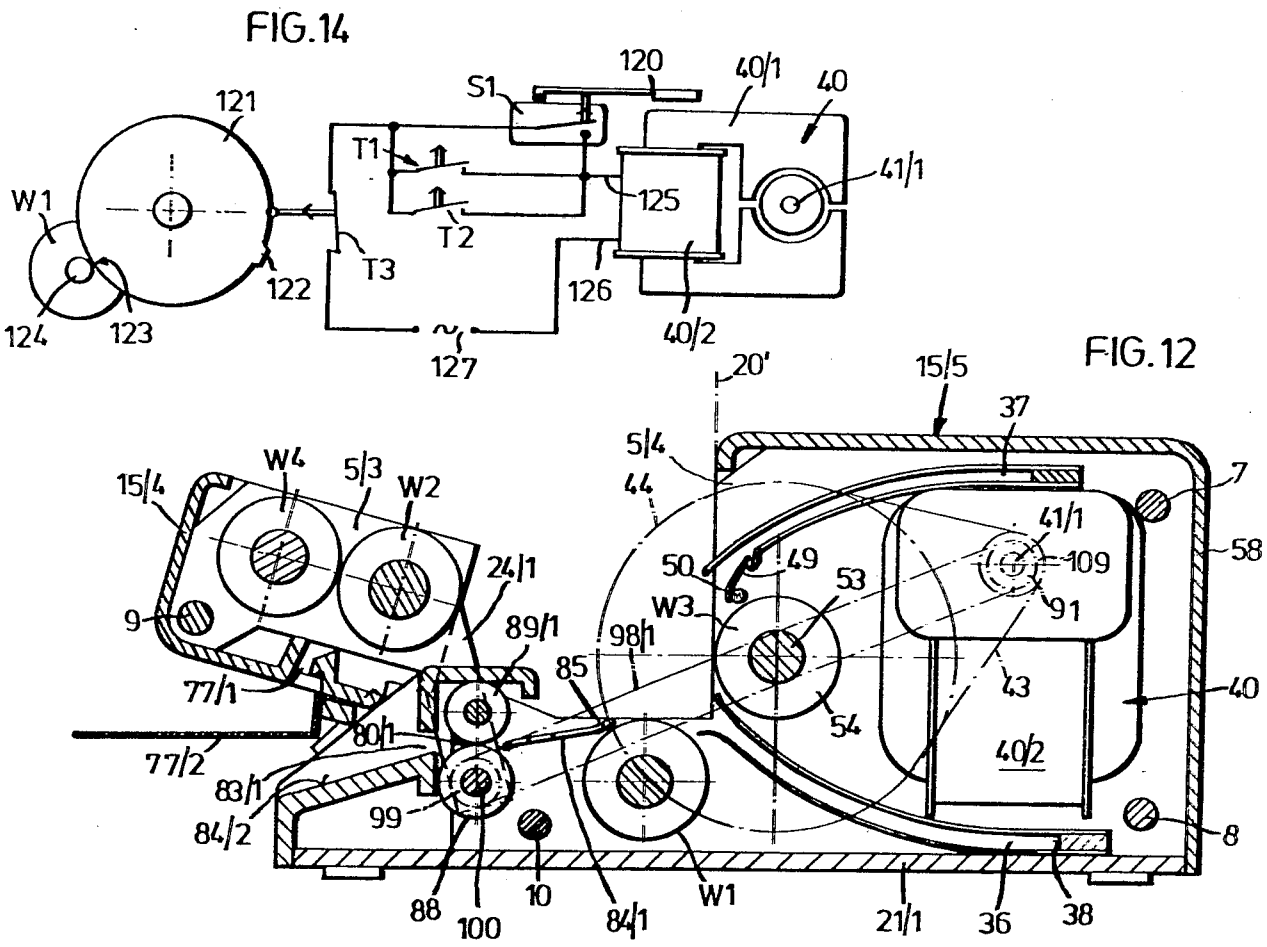
FIG. 12 shows the folding machine of FIG. 11 in open position.
FIG. 14 is a circuit diagram of the drive control of the folding machine.
Figure 13:
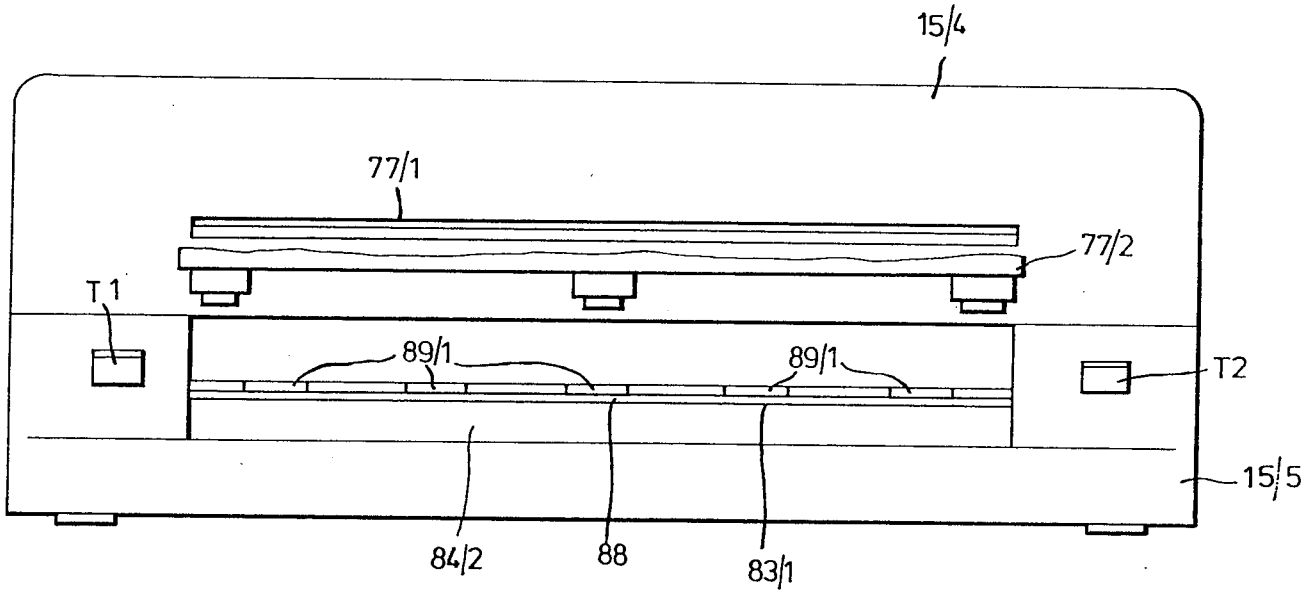
FIG. 13 shows the folding machine of FIG. 11 in front elevational view.

FIGS. 11, 12 and 13 show another embodiment of the folding machine according to the invention in section and front view, respectively the embodiment also containing an aligning device 80/1. It consists of the roller 88 connected to the shaft 100, and of several pressure rollers 89/1 provided in place of the balls 89 of the embodiment of FIG. 6, pressing the incoming material to be folded against the roller 88 and causing it to be taken along.

All parts in FIGS. 11 through 13 which were already described in connection with FIGS. 1 through 10 have the same reference symbols. Differing from the embodiment described above with reference to FIGS. 1 through 10, this embodiment illustrated in FIGS. 11 through 13 contains a fixed frame part 5/4 in which the rollers W1 and W3 are mounted stationarily while the other two rollers W2 and W4 are mounted in a movable frame part 5/3 which, in turn, is pivotably mounted on the shaft 100 by means of bearing plates 24/1 of the two frame chassis forming the movable frame part 5/3. In FIG. 11 which shows the closed, ready-to-operate condition of the folding machine, the roller W2 forms in the usual manner the take-in point or line E with the roller W1 on the one hand, and the first folding point or line I with the roller W3 on the other. Here, too, the separating line lies in the tangential plane 20'. Opened up, the movable frame part 5/3 assumes the position shown in FIG. 12 so that both folding pockets 36 and 37 as well as all four rollers are easily accessible. Fastened to this frame part 5/3 is a movable housing part 5/4 which also has the slotlike discharge opening 77/1 and is additionally provided with a removable supporting part 77/2 to catch the folded material 79.

It is evident from the drawing that in this embodiment a much smaller frame part 5/3 and also a much smaller housing part 15/4 than in the embodiments described earlier are movably provided and that opening the roller frame as well as the housing can simply be accomplished by pivoting the movable frame part 5/3 with the movable housing part 15/4 without the need to move the rest of the housing 15/5 in any which way. Disposed in the fixed frame part 5/4 between the aligning device 80/1 and the take-in point or line E is a guide plate 84/1 which is also provided with an end section 85 which is at least at a slight angle and guides the leading edge of the incoming material to be folded against the circumference of the roller W2 to be aligned there as described in connection with FIGS. 6 and 9. As indicated in FIG. 11, the material to be folded is introduced into the aligning device 80/1 through a slotlike feed opening 83/1. An inclined housing surface 84/2 of the fixed housing part 15/5 serves as guide surface. Differing from the embodiment of FIGS. 1 through 10, an undivided, through housing bottom 21/1 is provided in this embodiment example, on top of which the fixed housing part 15/5 is put.

The shaft 100 with the roller 88 of the aligning device 80/1 is driven by the electric motor in the same way as in the embodiment example of FIGS. 6, 7, 8 or 9, there being the advantage here, however, that the entire aligning device 80/1 is mounted in the fixed frame part 5/4 so that the two gears 94 and 96 can be omitted and the belt drive 99 of the shaft 100 can be in direct driving connection with the belt drive 91 of the motor shaft 41/1 via a belt 98/1. This also makes for a further simplification.

To control the electric motor 40 designed as split-pole motor, a control unit is used in the embodiment of FIGS. 11 through 13 as schematically shown in FIG. 14. This control unit contains two manually operable sensing switches T1 and T2, each disposed laterally next to the slotshaped feed opening 83/1 in the fixed housing part 15/5. Connected in parallel to these two sensing switches T1 and T2 is another switch S1 in the form of a closing switch disposed near the iron yoke 40/1 of the electric motor 40 and closed by a switching lever 120 as soon as the electric motor 40 has been turned on by actuating one of the two sensing switches T1 or T2. The switching lever 120 is attracted by the iron yoke 40/1 due to the magnetic leakage field, thereby closing the closing switch S1. The sensing switch T1 or T2 can then be opened again. The motor stays turned on via the switch S1 nevertheless.

Connected in series with the switches S1, T1, and T2 is a disconnect switch T3 which is actuated by a cam plate 121. This cam plate 121 has a switching cam 122 of very short circumferential length and is driven clockwise, via a friction clutch 123, directly by a shaft 124 such as of the roller W1 in such a manner as to perform a whole revolution during one folding work cycle, during which its cam 122 opens the disconnect switch T3 briefly. Due to this brief opening of the disconnect switch T3 the coil 40/2 of the electric motor 40 is deenergized. This causes the electromagnetic field to collapse, and the closing switch S1 is opened immediately which means that the motor stays shut off when the disconnect switch T3 closes again after the switching cam 122 has passed. It may be seen from FIG. 14 that the one winding end 125 of the coil 40/2 is connected to the fixed contacts of the sensing switches T1, T2 and of the switch S1, whereas the other winding end 126 is connected directly to the power source 127. The moving contacts of the two sensing switches T1 and T2 and of the switch S1 are connected to the fixed contact of the disconnect switch T3 whose moving contact is connected to the other pole of the power source 127.

This switching circuit operates as follows:

When the leading edge of a sheet of paper to be folded is introduced through the feed opening 83/1 until it is in contact with the roller 88 or the pressure rollers.89/1, the electric motor 40 is turned on due to the actuation of one of the two sensing switches T1 or T2. The electromagnetic field instantaneously erected thereby attracts the switching lever 120 and closes the switch S1 which automatically remains in this position until the motor is turned off again by opening the disconnect switch T3 at the end of the folding process. In order to effect a slower start, the motor shaft 41/1 of this embodiment is equipped with a disc flywheel (not shown). The disc 101 shown in FIG. 7 may be designed as a flywheel, for instance. This delayed start, in conjunction with the centrifugal clutch 90, assures that the leading edge of the sheet transported by the aligning device 80/1 against the circumference of the roller W2 is being aligned when the roller W2 is standing still, before it starts turning and before the material to be folded is being pulled in. With the folding rollers W1 through W4 the cam plate 121 is also caused to rotate. The reduction ratio between the shaft 124 of the roller W1 and the cam plate 121 has completed exactly one full revolution, thereby opening the disconnect switch T3 briefly and closing it again. Here again, the disc flywheel sees to it that the cam plate 121 does not stop instantaneously when the motor 40 is turned off upon opening the disconnect switch T3, but that it keeps turning by an angle of about 10° to 15°, coming to a stop only then.

This above described control unit has the advantage of requiring no electronic components whatsoever, which brings with it greater operating reliability, less susceptibility to trouble and, in addition, lower production costs.

While specific embodiments of the invention have been shown and described in detail to illustrate the application of the principles of the invention, it will be understood that the invention may be embodied otherwise without departing from such principles.

What is claimed is:

1. A folding machine for sheet material comprising:

a housing defining a space, having a sheet material in-take opening and a sheet material discharge opening;

a frame in said housing;

first, second, third and fourth rollers rotatably mounted to said frame and disposed in said housing, said rollers extending parallel to each other and defining between said first and second rollers a take-in nip, between said second and third rollers a first folding nip and between said second and fourth rollers a second folding nip:

means defining a feed path in said housing from said in-take opening through said take-in nip, said first folding nip and said second folding nip, and to said discharge opening;

a first pocket in said housing disposed on said path upstream of said first folding nip for facilitating folding of sheet material supplied to said pocket from said take-in nip and to said first folding nip from said pocket;

a second pocket in said housing disposed on said path downstream of said first folding nip for facilitating further folding of sheet material supplied to said second pocket from said first folding nip and from said second pocket to said second folding nip:

drive means connected to said first, second, third and fourth rollers for rotating said rollers to move sheet material along said feed path: and a feed table connected to said housing and extending toward said in-take opening for at least partly supporting sheet material to be supplied into said in-take opening and onto said feed path:

said housing and said frame each being divided into two parts along a dividing plane which is near a tangent plane to said first folding nip, said two parts being connected to each other for movement between a closed position with said housing space closed around said frame and said rollers, and an open position with said rollers and said pockets exposed and said housing space open, at least said second and said fourth rollers mounted on one of said parts of said frame and said third roller mounted on the other of said parts of said frame, said take-in nip and said second folding nip as well as said in-take opening and said discharge opening of said housing disposed on one side of said tangent plane and said third roller disposed on an opposite side of said tangent plane.

2. A folding machine according to claim 1, wherein said second and fourth rollers defining said second folding nip therebetween are rotatably mounted to said one part of said frame, said first and third rollers rotatably mounted to said other part of said frame so that with said parts in their open position, said second and fourth rollers are swung away from said first and third rollers to expose said pockets and to open said take-in nip and said first folding nip.

3. A folding machine according to claim 2, wherein said housing part containing said one part of said frame which rotatably supports said second and fourth rollers contains said discharge opening.

4. A folding machine according to claim 1, wherein said drive means includes gears connected to each one of said first, second, third and fourth rollers, which gears are mutually meshed with each other and an electric motor disposed in said housing and operatively connected to one of said gears for rotating all of said gears.

5. A folding machine according to claim 1, wherein each of said folding pockets is at least partly curved, each including a fixed stop at an end thereof for stopping a progression of sheet material moving into a respective poc- ket.

6. A folding machine according to claim 5, wherein said second folding pocket includes an input end opposite from its fixed stop, said second pocket including a movable flap movable to close said input end and serving as a guide plate along said feed path for moving sheet material directly from said first folding nip to said second folding nip without entering said second pocket.

7. A folding machine according to claim 1, wherein said feed table extends in a direction toward an outside surface of one of said first and second rollers whereby, with said rollers at a standstill, sheet material moved along said feed table against said outside surface is stopped and aligned for entry into said take-in nip.

8. A folding machine according to claim 1, including a sensing switch disposed on said feed path in said housing adjacent said in-take opening for detecting the passage of sheet material, time delay means connected between said sensing switch and said drive means for activating said drive means at a selected time delay after said sensing switch senses the passage of sheet material and for deactivating said drive means after a selected additional period of time.

9. A folding machine according to claim 7, including a sensing switch disposed on said feed path in said housing adjacent said in-take opening for detecting the passage of sheet material, time delay means connected between said sensing switch and said drive means for activating said drive means at a selected time delay after said sensing switch senses the passage of sheet material and for deactivating said drive means after a selected additional period of time.

10. A folding machine according to claim 8, wherein said drive means comprises an electric motor having a shaft, said time delay means comprising a clutch connected between said shaft and engaged with said rollers for rotating said shaft at the selected time delay after activation of said electric motor.

11. A folding machine according to claim 10, wherein said feed table extends in a direction to supply sheet material into an outer surface of one of said first and second rollers for stopping and aligning sheet material when said rollers are motionless.

12. A folding machine according to claim 11, including transport means in said housing on said feed path between said in-take roller and said take-in nip, said alignment means connected to said sensing switch for being activatable without time delay when said sensing switch senses the passage of sheet material, said alignment means functioning to transport sheet material to said outer surface of one of said first and second rollers.

13. A folding machine according to claim 12, wherein said alignment means comprises a transport roller rotatably mounted in said housing parallel to said first, second, third and fourth rollers, said transport roller connected to said motor shaft for rotating said transport roller to feed sheet material along said feed path, said means defining said feed path including a guide plate extending between said in-take opening and said outer surface of said one of said first and second rollers, said transport roller extending partly through said guide plate for engaging sheet material and at least two spaced apart pressure balls resting on said transport roller for cooperation therewith to transport sheet material to said outer surface of said one of said first and second rollers.

14. A folding machine according to claim 13, wherein a transport distance between said transport roller and said take-in nip along said feed path is at most equal to a circumferential length of said transport roller.

15. A folding machine according to claim 1, wherein said drive means comprises an electric motor engaged with said rollers for rotating said rollers to move sheet material along said feed path, a mechanical switch activatable when sheet material moves along said feed table to enter said in-take opening a closing switch connected in parallel to said at least one mechanical switch and closeable by a magnetic leakage field of said electric motor, said closing switch being maintained closed during a working cycle of said electric motor, and a cam rotatable once during said working cycle and mounted in said housing, a disconnect switch connected in series to said at least one mechanical switch and said closing switch and being normally closed but briefly openable by passage of said cam plate, said disconnect switch being connected to said electric motor for deactivating said electric motor at the end of a duty cycle.

16. A folding machine according to claim 1, wherein said one part of said frame rotatably carries said first, second and fourth rollers and said one part of said housing contains said take-in nip and said second folding nip, said other part of said housing rotatably mounting said third roller.

17. A folding machine according to claim 16, wherein said first and second parts of said frame are respectively connected to first and second parts of said housing, said first and second parts of said frame being pivotally connected to each other near a bottom of said housing and including locking means near a top of said housing for locking said housing parts and said frame parts in their closed position.

18. A folding machine according to claim 1, wherein said housing includes a bottom, a support below said bottom for supporting said bottom in an inclined position, one of said housing parts being maintained at said inclined position with said housing open and the other part of said housing being rotated to another position.

19. A folding machine according to claim 1, wherein said housing includes a front wall having a lower portion extending at an acute angle with respect to the horizontal and an upper portion extending at another acute angle, said frame and housing parts being pivotally connected to each other near a bottom of said housing so that said lower front housing part rests against a horizontal surface with said housing open.

20. A folding machine according to claim 1, wherein said discharge opening is disposed above said feed table and said in-take opening and at a distance from said second folding nip which is about one half a final folded size of sheet material to be folded in said machine.

* * * * *